US009155337B2

(12) United States Patent
Duncan et al.

(10) Patent No.: US 9,155,337 B2
(45) Date of Patent: Oct. 13, 2015

(54) USAGE CONTROL OF ELECTRONIC CIGARETTE

(71) Applicant: Elwha LLC, Bellevue, WA (US)

(72) Inventors: William D. Duncan, Kirkland, WA (US); Roderick A. Hyde, Redmond, WA (US); Jordin T. Kare, Seattle, WA (US); Robert C. Petroski, Seattle, WA (US); Lowell L. Wood, Jr., Bellevue, WA (US)

(73) Assignee: Elwha LLC, Bellevue, WA (US)

( * ) Notice: Subject to any disclaimer, the term of this patent is extended or adjusted under 35 U.S.C. 154(b) by 0 days.

(21) Appl. No.: 14/063,592

(22) Filed: Oct. 25, 2013

(65) Prior Publication Data

US 2015/0114407 A1 Apr. 30, 2015

(51) Int. Cl.
*A24F 47/00* (2006.01)

(52) U.S. Cl.
CPC ..... *A24F 47/004* (2013.01); *A24F 47/008* (2013.01)

(58) Field of Classification Search
CPC ..... A24F 47/008
See application file for complete search history.

(56) References Cited

U.S. PATENT DOCUMENTS

| | | | | |
|---|---|---|---|---|
| 2011/0036346 | A1 | 2/2011 | Cohen et al. | |
| 2011/0277764 | A1 | 11/2011 | Terry et al. | |
| 2012/0048266 | A1 * | 3/2012 | Alelov | 128/202.21 |
| 2013/0319439 | A1 * | 12/2013 | Gorelick et al. | 131/329 |

OTHER PUBLICATIONS

Li et al., i-Function of Electronic Cigarette, Building Social Network by Electronic Cigarette, IEEE International Conferences on Internet of Things, and Cyber, Physical and Social Computing, Oct. 2011, 7 pages.

* cited by examiner

*Primary Examiner* — Michael J Felton
(74) *Attorney, Agent, or Firm* — Foley & Lardner LLP

(57) ABSTRACT

An electronic cigarette includes a housing, an atomizer disposed in the housing, and a control circuit disposed in the housing and configured to control operation of the atomizer based on time data regarding a current time.

14 Claims, 8 Drawing Sheets

304 302

| TIME | PERSON |
| --- | --- |
| TIME 1 | PERSON 1 |
| TIME 2 | PERSON 2 |
| TIME 3 | PERSON 3 |

FIG. 9

USAGE CONTROL OF ELECTRONIC CIGARETTE

BACKGROUND

Electronic cigarettes are typically designed to simulate use of a conventional cigarette, by providing an inhalable substance that may include nicotine, flavorants, or other additives or substances. When a user inhales, an atomizer, or vaporizer, vaporizes a fluid such that the fluid can be inhaled by a user of the electronic cigarette.

SUMMARY

One embodiment relates to an electronic cigarette comprising a housing; an atomizer disposed in the housing; and a control circuit disposed in the housing and configured to control operation of the atomizer based on time data regarding a current time.

Another embodiment relates to an electronic cigarette comprising a housing; an atomizer disposed in the housing; and a control circuit disposed in the housing and configured to control operation of the atomizer based on location data.

Another embodiment relates to An electronic cigarette comprising a housing; an atomizer disposed in the housing; and a control circuit disposed in the housing and configured to control operation of the atomizer based on time and location data.

Another embodiment relates to an electronic cigarette comprising a housing; an atomizer disposed in the housing; and a control circuit disposed in the housing and configured to control operation of the atomizer based on the presence of a proximate person.

Another embodiment relates to an electronic cigarette comprising a housing; an atomizer disposed in the housing; a transceiver disposed in the housing and configured to receive a control signal; and a control circuit disposed in the housing and coupled to the transceiver, the control circuit configured control operation of the atomizer based on the control signal.

Another embodiment relates to a method of controlling operation of an electronic cigarette comprising receiving time data at a processing circuit; and controlling operation of an atomizer of an electronic cigarette based on the time data.

Another embodiment relates to a method of controlling operation of an electronic cigarette comprising receiving location data at a processing circuit; and controlling operation of an atomizer of an electronic cigarette based on the location data.

Another embodiment relates to a method of controlling operation of an electronic cigarette comprising receiving time data at a processing circuit; receiving location data at the processing circuit; and controlling operation of an atomizer of an electronic cigarette based on the time and location data.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

FIG. 9 is a schematic illustration of various usage control data that may be stored for various users of an electronic device according to another embodiment.

DETAILED DESCRIPTION

Figure 1:
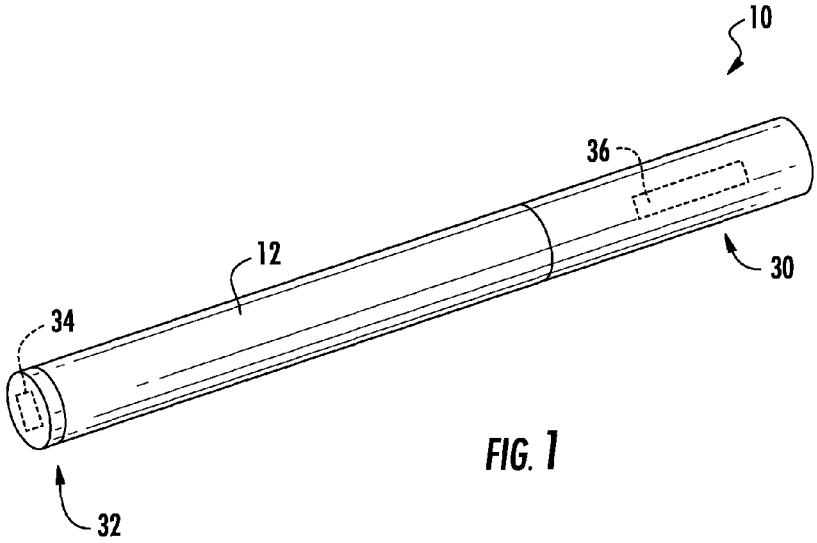
FIG. 1 is a perspective view of an electronic cigarette according to one embodiment.

In the following detailed description, reference is made to the accompanying drawings, which form a part thereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

Referring to the figures generally, various embodiments disclosed herein relate to electronic cigarettes, and more specifically, to operational control of electronic cigarettes based on various factors such as, but not limited to, time, location, nearby people, and the like.

Generally, an "electronic cigarette" (e.g., an e-cigarette, an atomizer, a vaporizer, an electronic nicotine delivery system) is an electronic device intended to simulate use of a conventional cigarette. Typically, electronic cigarettes utilize a heating element or similar component (e.g., an atomizer or vaporizer) that atomizes, or vaporizes, a liquid (sometimes referred to as "e-juice" or "e-liquid") contained within the electronic cigarette, such that the user inhales the atomized/vaporized liquid. The liquid may include nicotine, flavor additives, or other substances (e.g., propylene glycol, vegetable glycerin, polyethylene glycol). A sensor may be used to actuate the heating element upon sensing that a user is inhaling through the electronic cigarette. It should be noted that while various embodiments disclosed herein may generally refer to an "electronic cigarette," or "electronic cigarette device," the teachings herein extend to a variety of different devices that may be referred to using different terminology, including e-cigarettes, personal atomizing/vaporizing/inhaling devices, and the like. All of these devices generally provide an electronic device that delivers an inhalable substance to users.

Although the use of electronic cigarettes may provide certain benefits over the use of conventional cigarettes, such as the elimination of tar or other undesirable substances, there may still be situations (e.g., times of day, certain locations, being near other individuals) when it is desirable to limit (e.g., prevent, reduce, or modify) the use of electronic cigarettes. As such, various embodiments herein relate to controlling the operation of an electronic cigarette based on time (e.g., a current time), location (e.g., a current location), nearby people (e.g., children or relatives), control signals (e.g., signals received while within a particular establishment that does not permit usage of electronic cigarettes), or other control parameters.

Referring now to FIG. 1, electronic cigarette device 10 is shown according to one embodiment. Device 10 includes body 12 (e.g., a housing or exterior) having first end 30 and second end 32. Input device 34 and output device 36 may be disposed within or supported by body 12. As shown in FIG. 1, input device 34 is generally at or adjacent second end 32, and output device 36 is generally at or adjacent first end 30. In other embodiments, output device 36 and input device 34 can be disposed at other locations of body 12. A light such as usage light 38 may be provided at second end 32 to indicate usage periods for device 10. Typically, a user holds device 10 by way of body 12, inhales through first end 30, and device 10 in response atomizes a liquid that can be inhaled by the user. As such, and as discussed in greater detail below, body 12 can house or support various components that enable proper operation of device 10.

In one embodiment, input device 34 is configured to capture (e.g., receive or acquire) data regarding the surroundings of a user of device 10. For example, input device can be or include a camera configured to capture still or video images of nearby persons (e.g., to enable use of a facial recognition program configured to identify one or more nearby persons based on the captured data). Alternatively, input device 34 can be or include a microphone configured to record sounds such as voices of nearby persons (e.g., to enable use of a voice recognition program configured to identify one or more nearby persons based on the captured data). In a further embodiment, input device 34 can be or include a sensor configured to sense when a user is touching, for example, body 12 of device 10 (e.g., to predict an impending use of device 10 by a user). According to various further embodiments, input device 34 can be any type of input device suitable for integration into device 10 and capable of receiving data regarding the environment, nearby persons, a user of device 10, and the like.

In one embodiment, output device 36 is configured to provide various outputs to, for example, a user of device 10 or to nearby persons. Output device 36 can provide visible outputs (e.g., lights), audible outputs (e.g., via a speaker), tactile outputs (e.g., vibrations), or other outputs according to various alternative embodiments. For example, output device 36 can be configured to provide a beeping sound, a constant or flashing light, a vibration sensation, and so on. As discussed in detail below, output device 36 can in some embodiments be activated based on a predicted, attempted, or actual use of device 10 by a user.

Figure 2:
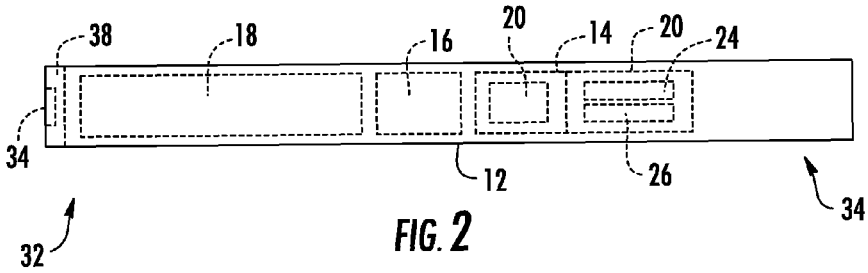
FIG. 2 is a side schematic view of the electronic cigarette of FIG. 1 according to one embodiment.

Referring to FIGS. 1-2, device 10 further includes atomizer assembly 14, control circuit 16, and power supply or power source 18. Atomizer assembly 14 can include liquid reservoir 20 and heating element 22. Liquid reservoir 20 is configured to hold liquid 23, and may include one or more sub-reservoirs 24, 26 to provide liquids of different composition, nicotine content, flavor, etc. During use of device 10, heating element 22 is configured to atomize or vaporize liquid 23 such that the vaporized liquid can be inhaled by a user. Control circuit 16 is configured to control operation of atomizer assembly 14. As discussed in further detail below, controlling the operation of atomizer assembly 14 may include, among other things, permitting/preventing operation of the atomizer assembly, reducing the amount of liquid that is atomized, modifying the type of liquid that is vaporized, and the like. As such, liquid from one or both of sub-reservoirs 24, 26 may be selectively used in operation of device 10 based on various usage control parameters (e.g., to provide a modified substance to the user). Control of atomizer assembly 14 can be based on a variety of factors, including time, location, nearby persons, receipt of a control signal, or other factors. In some embodiments, liquid reservoir 20 can be, or be disposed in, a removably attachable component (e.g., a refill cartridge). In such embodiments, the refill cartridge can contain memory encoding one or more of the control parameters or time/location/identification data discussed below. For example, a refill cartridge containing a legally regulated substance can include control parameters restricting use of the substance to specific locations, users, or times. As discussed in greater detail below, power source 18 can be or include any suitable power source capable of providing power to the various components of device 10.

Figure 3:
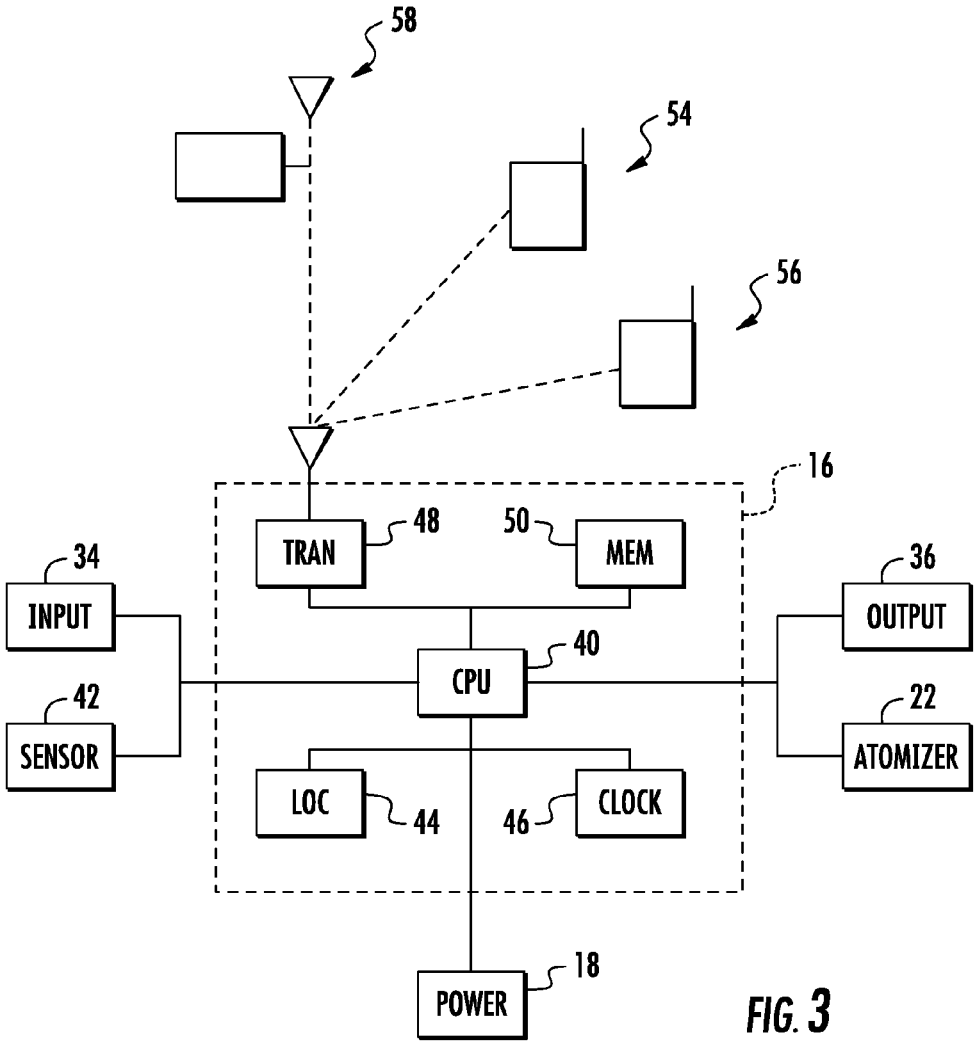
FIG. 3 is a schematic block diagram of a control circuit for an electronic cigarette according to one embodiment.

Referring now to FIG. 3, various components of a processing circuit shown as control circuit 16 are shown according to one embodiment. As shown in FIG. 3, control circuit 16 includes processor 40, location determining circuit 44, clock 46, transceiver 48, and memory 50. It should be noted that while certain components of control circuit 16 are depicted in FIG. 3 as discreet components, in various embodiments certain components may be combined, omitted, or subdivided, depending on the particular configuration of device 10. Control circuit 16 may further include other components not illustrated in FIG. 3.

Processor 40 can be any suitable processing device capable of controlling the operation of device 10 and communicating with the various other components of control circuit 16 or various remote devices. Memory 50 is coupled to processor 40, and is configured to store data received from various other components of circuit 16, and may provide for any suitable type(s) of memory. In some embodiments, memory 50 can store usage control data, or parameters, corresponding to one or more users of device 10 (see, e.g., FIGS. 8-9).

Location determining circuit 44 is configured to determine, among other things, a current location of device 10. The current location of device 10 can be determined in a variety of ways according to various alternative embodiments. For example, in some embodiments location determining circuit 44 can include a global position system (GPS) configured to determine a current location of device 10. In other embodiments, location determining circuit 44 can determine an approximate location of device 10 based on identifying the location of a user's cell phone or other mobile device, the location of a nearby cell tower, Wi-Fi hotspot, etc. Other methods of determining a location of device 10 can be used according to various other embodiments.

In some embodiments, control circuit 16 includes clock 46. Clock 46 is configured to provide time data such as a current time (e.g., time of day, day of week, month, year, etc.) to processor 40 or other components of device 10. While in some embodiments clock 46 can be an internal clock, in other embodiments, clock 46 can be omitted or modified to receive time data from a remote source such as a user's mobile device (e.g., cellular phone) or another remote time source.

Transceiver 48 is configured to transmit and/or receive data between device 10 and other devices. According to various alternative embodiments, transceiver 48 can provide wireless communications via a wide range of communications protocols, including cellular communications, Wi-Fi communications, Bluetooth communications, and infrared communications. As discussed in greater detail below, device 10 can communicate with a wide range of devices. For example, should a user of device 10 also be carrying a cellular phone or other similar device (see, e.g., mobile device 54 shown in FIG. 3), device 10 can communicate with such device. Device 10 can also communicate with other mobile phones or similar devices 54, or remote signal stations 58 (e.g., signal beacons, signal generators).

In one embodiment, power source 18 includes a battery. The battery may be a disposable battery, a rechargeable battery, and/or a removable battery. According to various other embodiments, other suitable power sources may be used to provide power to the various components of device 10. Furthermore, device 10 can be configured such that power source 18 is rechargeable while remaining within body 12 of device 10 (e.g., by way of a charging outlet).

Referring further to FIG. 3, control circuit 16 receives inputs from input device 34 and/or sensor 42, and can provide various outputs to and control the operation of output device 36 and atomizer assembly 14. Inputs can comprise time data, location data, control parameters, instructions or programs governing control of device 10 or software running thereon, firmware, or the like. As noted above, control circuit 16 can control the operation of atomizer assembly 14 and provide various outputs based on data received via sensor 42 or input 34, stored in memory 50, etc. For example, based on various usage control parameters, control circuit 16 may permit unrestricted usage of device 10; permit limited, restricted, or modified usage of device 10 (e.g., by limiting the amount or type of liquid atomized); or prevent use of device 10 entirely. Use of device 10 may be modified in a variety of ways including, but not limited to, limiting an amount of nicotine (or other substance, such as tetrahydrocannibinol (THC)), utilizing a non-nicotine material (e.g., an alternative flavorant or stimulant), or in other ways.

Figure 4:
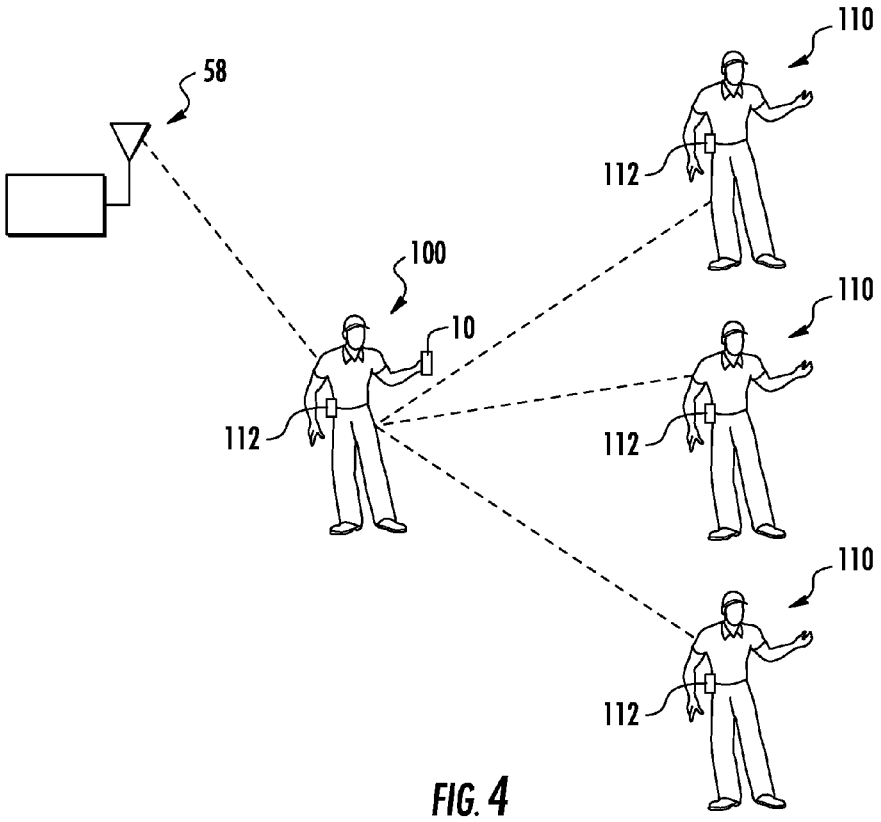
FIG. 4 is an illustration of a user of an electronic cigarette in the vicinity of other persons according to one embodiment.

Referring to FIG. 4, user 100 of device 10 is shown nearby other persons 110 having mobile devices 112 (e.g., additional electronic cigarettes, cellular phones). In addition to device 10, user 100 may also be carrying mobile device 102. In some embodiments, in order to acquire data regarding time, location, or nearby persons 110, device 10 can communicate with one or more of mobile devices 102, 112. For example, based on communicating with one or more of mobile device 112, device 10 can identify the corresponding users (e.g., via an electronic contacts list). Alternatively, device 10 can utilize input device 34 to capture still or video images, voice sounds, or other data to determine the identity or demographics of nearby persons (e.g., by utilizing a facial or voice recognition application). Furthermore, device 10 can communicate with control signal station 58, which may be or include a remote transceiver configured to transmit data relating to usage control parameters for electronic cigarettes for a particular location such as a school, library, bar, etc.

In use, control circuit 16 is configured to control operation of device 10 (e.g., atomizer assembly 22) based on various factors. As discussed in detail below, such factors may be associated with data received via input device 34, sensor 42, or transceiver 48, and may relate to time, location, nearby persons, the receipt of control signals, or other factors. While in some embodiments control of device 10 is largely performed "on-board" the device, according to various alternative embodiments, various data storage (e.g., storage of usage control data) or processing functions (e.g., usage restriction determinations) can be performed remotely (e.g., via a user's cellular/smartphone), such that only a control signal (e.g., an on/off signal) need be sent to device 10.

In one embodiment, memory 50 is configured to store usage control data received from a user. Usage control data defines the limitations, or modifications, applicable to device 10 for one or more users of an electronic cigarette device such as device 10. For example, usage control data can define situations (e.g., time periods, locations) for which usage of device 10 may be limited or prevented for a particular user. The usage control data can be received via a wired or wireless connection from a variety of sources, including other mobile devices and other remote computing devices (e.g., notebook, laptop, desktop computer devices, web-based applications running on remote devices, etc.). As such, the usage control data is configurable by users to define different control parameters for different users of device 10.

Figure 8A:
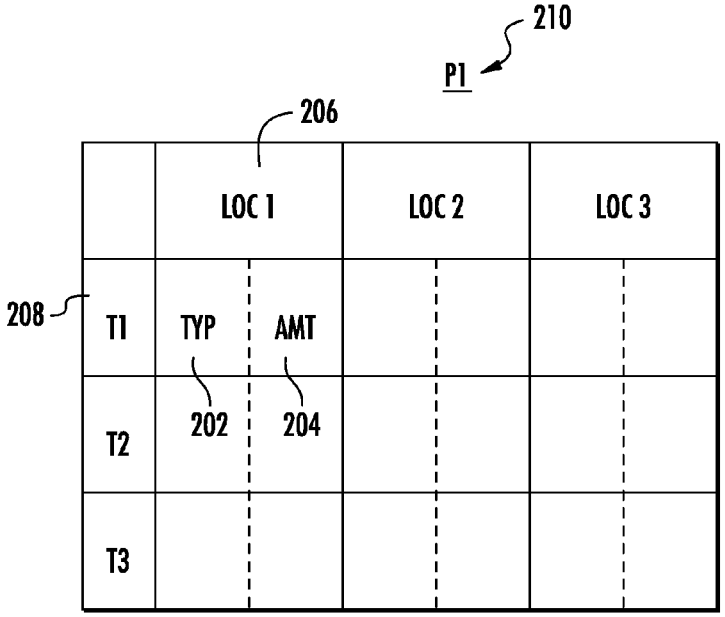
FIGS. 8A and 8B are schematic illustrations of various usage control data that may be stored for various users of an electronic device according to one embodiment.
Figure 8B:
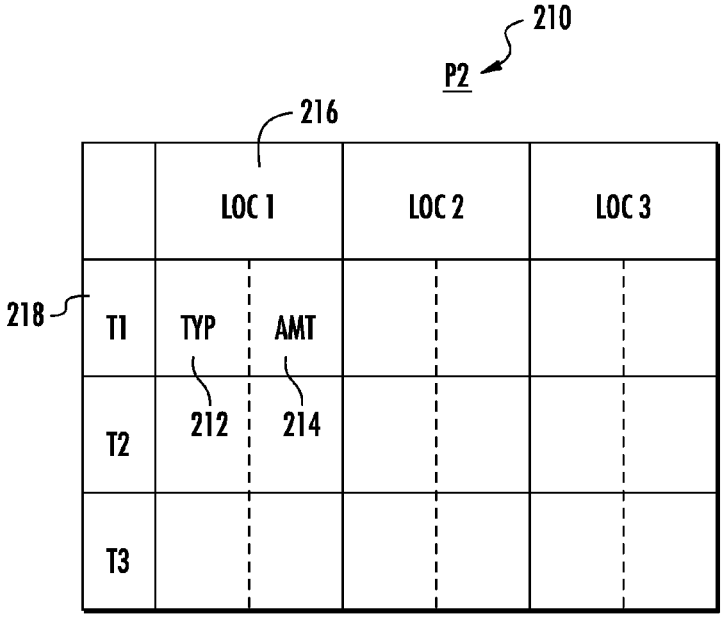

For example, referring to FIG. 8, usage control data can include location and time information indicating for example, the type of liquid 202 (e.g., nicotine content, flavor content) or amount of liquid 204 that can be used by device 10 during various time periods 206, or while device 10 is at certain locations 208. As shown in FIG. 8, locations 206, time periods 208, and type 202 and amount 204 of liquid are associated with a first user 210, and locations 216, time periods 218, and type 212 and amount 214 of liquid are associated with a second user 220. As such, device 10 can be configured to identify a particular user (e.g., by facial recognition, voice recognition, identifying a user's cellular phone or other mobile device, receiving a user identification input, etc.) and apply the corresponding usage control data for device 10.

Usage control data can further define limitations based on specific persons, or persons of specified demographics (e.g., children), being nearby. For example, referring to FIG. 9, various persons 302 can be associated with user 310, such that use of device 10 may be limited, modified, and/or prevented when device 10 and user 310 are nearby (e.g., within a certain distance of, or within a same establishment as) one or more of persons 302. In various alternative embodiments, time periods 304 can be associated with each person 302, such that limitations on the use of device 10 near certain persons may apply only during specified time periods. Similar to the usage data shown in FIG. 8, the usage data shown in FIG. 9 may be user specific, such that different users of device 10 can specify different persons, time restrictions, and the like.

Figure 5:
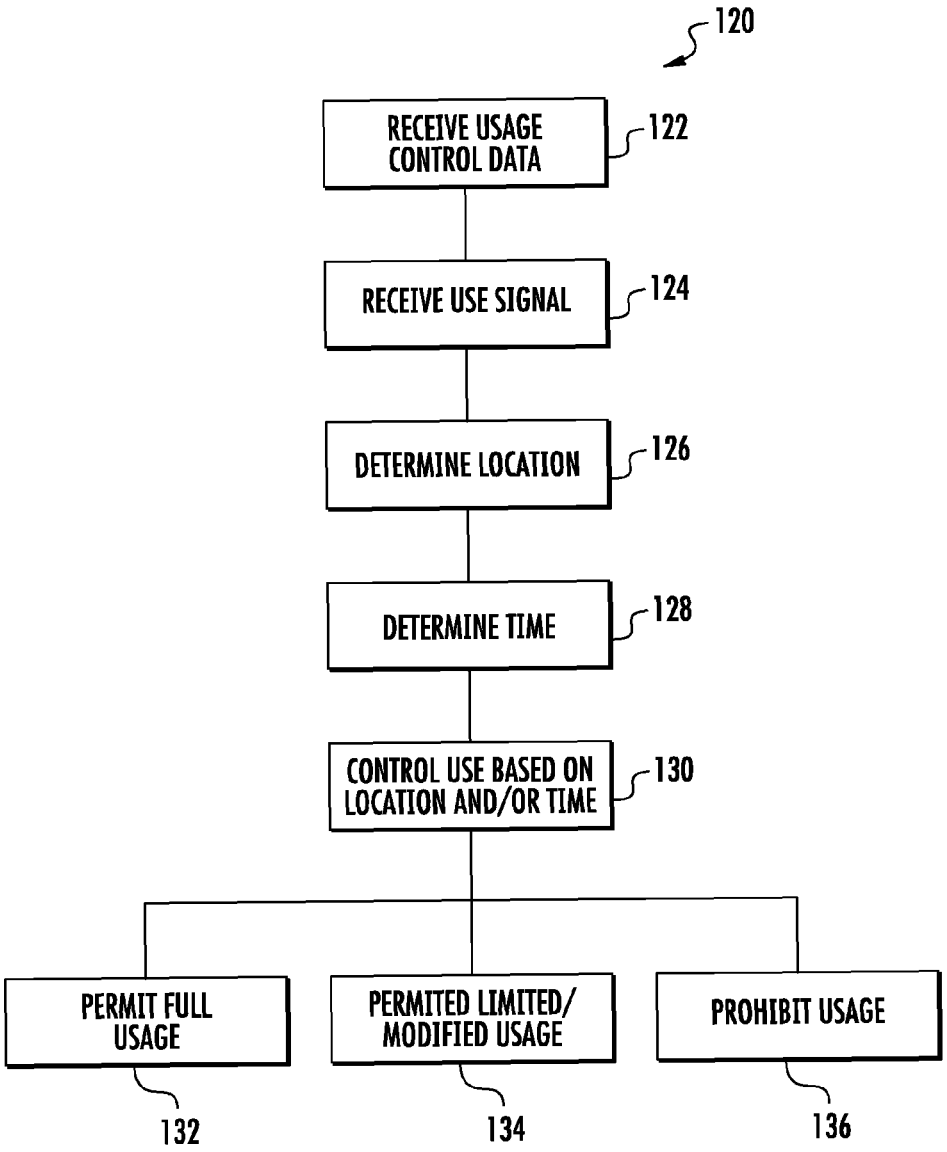
FIG. 5 is a block diagram illustrating a method of controlling operation of an electronic cigarette according to one embodiment.

Referring now to FIG. 5, method 120 of controlling usage of an electronic cigarette device is shown according to one embodiment. First, usage control data is received by a control circuit (122). As noted above, usage control data can relate to a variety of factors, including time, location, nearby persons, or combinations thereof. Furthermore, usage control data can be user specific, and can be configured by users to enable users to change various values of the usage control data. The device then receives a use signal (124). A use signal may include a variety of inputs that indicate an actual or predicted use of the device. For example, a user inhaling through the device may trigger a sensor that notifies the control circuit that a user is currently using the device. Alternatively, a touch sensor may be configured to sense when a user touches the device and notify the control circuit that a user may be using the device in the near future. The use signal may further identify which of a number of potential users are currently using the device.

Along with receiving the use signal, the control circuit determines a current location (126) and a current time (128). As discussed in detail above, location and time data can be determined on-board the electronic cigarette device, or alternatively, received from another device (e.g., via a wired or wireless connection), such as a user's cellular phone. Based on the location and time data, the control circuit controls operation of the electronic cigarette device (130). In some instances, the control circuit can determine that based on the data, a user can use the device in an unrestricted manner (132). In some instances, usage of the device at a given location (e.g., a business establishment) can be prohibited at some times (e.g., during office hours) but be permitted at other times (e.g., during nights or weekends). Alternatively, the control circuit can permit limited/modified use of the device (134), or prevent use of the device entirely (136). For example, referring to FIG. 8, should the processing circuit determine that a first user 210 (P1) is using the electronic device at location 206 (LOC 1) during time period 208 (T1), the processing circuit will limit use of device 10 to an amount of liquid 204 and a type of liquid 202. In some embodiments, this may result in a user being prevented from using the device. In other embodiments, this may result in the amount or type of liquid being used to be modified (e.g., to provide reduced nicotine content, alternative or enhanced flavoring, etc.).

It should be noted that while FIG. 5 depicts a method of controlling operation of an electronic cigarette device based on both time and location data, in some embodiments, control of the device may be based on only one of these factors, or alternatively, one of these factors and additional other factors. For example, in one embodiment, the control circuit can control usage based only on location data. In such a case, use of the device may always be prevented, for example, within a school or other specified location, regardless of the current time. In another such case, use of the device to atomize certain substances (e.g., THC) may be permitted in some locations and prohibited in other locations, due to local laws or regulations. In other embodiments, the control circuit can control usage based only on time data. In such a case, use of the device may always be prevented at certain times, regardless of the location of the user. In another case, use of the device may be permitted, but time data can be used to control the operation of the device, for instance by controlling the start of an atomization event, the duration of atomization event, or by controlling the time between atomization events (e.g., only once every five minutes). In yet further embodiments, time and location data can be combined individually or together with yet other usage control factors to control operation of an electronic cigarette device. All such combinations are to be understood to be within the scope of the present disclosure.

Figure 6:
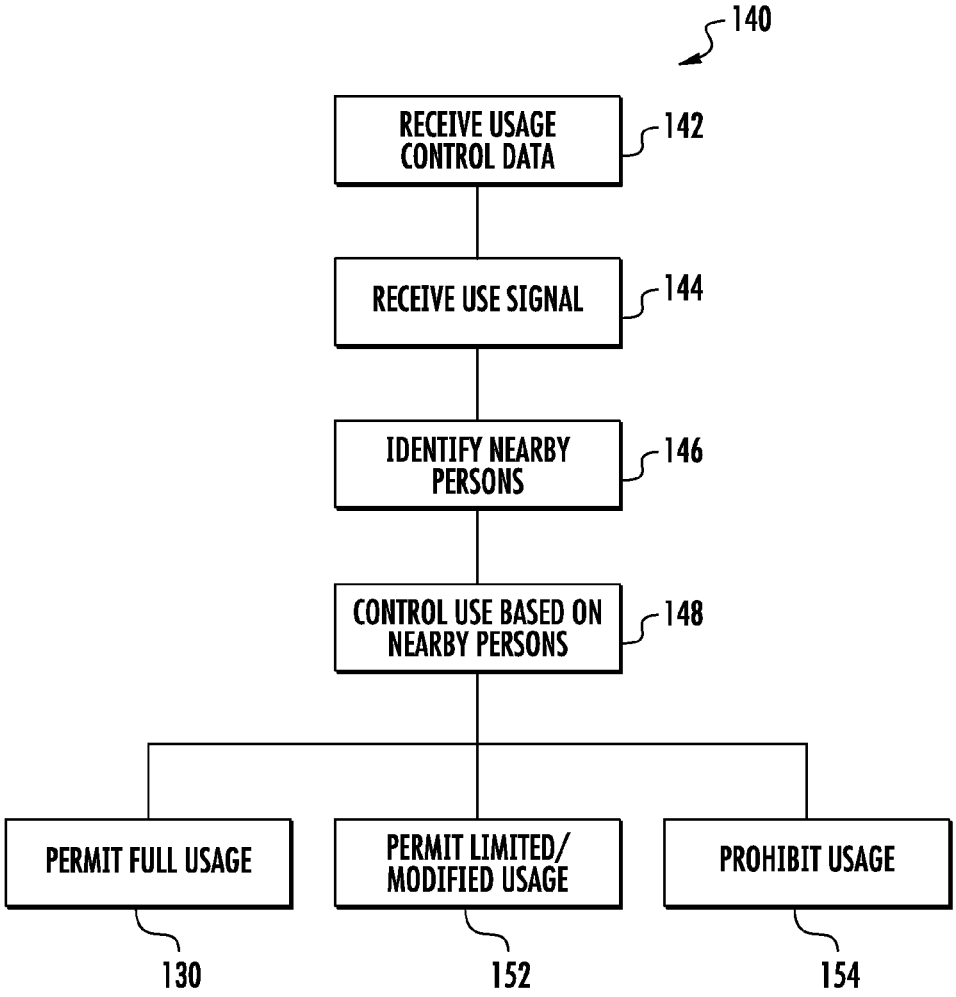
FIG. 6 is a block diagram illustrating a method of controlling operation of an electronic cigarette according to another embodiment

Referring now to FIG. 6, method 140 of controlling usage of an electronic cigarette device is shown according to one embodiment. First, usage control data is received by a control circuit (142). As noted above, usage control data can relate to a variety of factors, including time, location, nearby persons, or combinations thereof. Furthermore, usage control data can be user-specific, and can be configured by users to change various values of the usage control data. The device than receives a "use signal" (144). A use signal may include a variety of inputs that indicate an actual or predicted use of the device. For example, a user inhaling through the device may trigger a sensor that notifies the control circuit that a user is currently using the device. Alternatively, a touch sensor may be configured to sense when a user touches the device and notify the control circuit that a user may be using the device in the near future. The use signal may further identify which of a number of potential users are currently using the device.

Along with receiving the use signal, the control circuit determines whether one or more persons are nearby the device (146). Determining whether one or more persons are nearby can occur before, during, or after receiving the use signal. As discussed in detail above, the control circuit can utilize facial recognition, voice recognition, communications between mobile devices, or other methods to identify one or more persons nearby a user of the electronic cigarette device.

Based on the identified persons, the control circuit controls operation of the electronic cigarette device (148). In some instances, the control circuit can determine that based on the data, a user can use the device in an unrestricted manner (150). Alternatively, the control circuit can permit limited/modified use of the device (152), or prevent use of the device entirely (154). For example, referring to FIG. 9, should the processing circuit determine that a first user is using the electronic device nearby a person 302 (PERSON 1), the processing circuit may prevent or limit use of the device. In some embodiments, this may result in a user being prevented from using the device. In other embodiments, this may result in the amount and/or type of liquid being used to be modified (e.g., to provide reduced nicotine content, alternative and/or enhanced flavoring).

One or more time periods 304 can further be associated with each person 302 listed in FIG. 9, such that in some embodiments, operation of the device is only prevented/modified when a user is nearby certain persons during specific time periods. For example, should a user's significant other ask that the user not use the device around the significant other during morning hours, usage control data such as that shown in FIG. 9 can be configured to control operation of the device around the user's significant other only during morning hours (e.g., such that the device would be operable on an unrestricted basis during, for example, afternoon or evening hours).

It should be noted that while FIG. 6 depicts a method of controlling operation of an electronic cigarette device based on nearby persons and/or time data, in some embodiments, control of the device may be based on additional or different factors. For example, in one embodiment, the control circuit can control usage based further on location data (i.e., instead of or in addition to time data). In yet further embodiments, the identification of nearby persons, time, or location data can be combined individually or together with yet other usage control factors to control operation of an electronic cigarette device. Furthermore, in some embodiments, rather than basing usage restrictions on the particular identity of nearby persons, in some embodiments, usage of the device can be controlled based on the presence of nearby persons (e.g., such that the device is not operable or operable on a limited or modified basis when a minimum number of people (e.g., 1, 2, 3) are nearby), regardless of the actual identity or demographics (e.g., age, gender, attire) of such persons. All such features and combinations of features are to be understood to be within the scope of the present disclosure.

Figure 7:
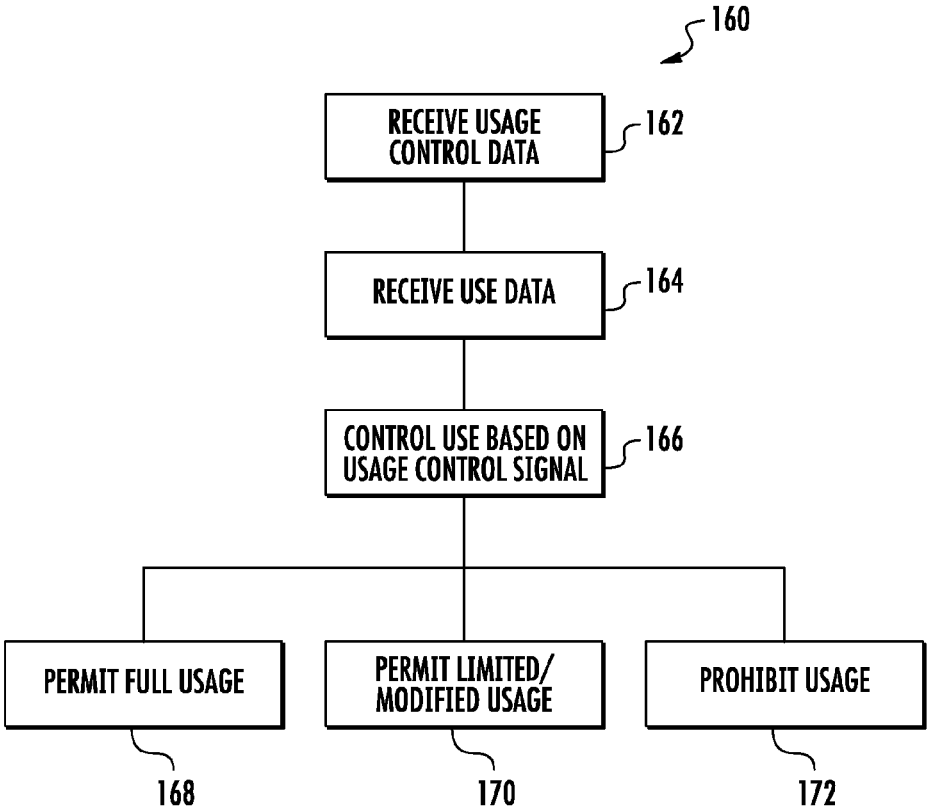
FIG. 7 is a block diagram illustrating a method of controlling operation of an electronic cigarette according to another embodiment.

Referring now to FIG. 7, method 160 of controlling usage of an electronic cigarette device is shown according to one embodiment. First, usage control data is received. In one embodiment, receipt of the usage control data can include receipt of a usage control signal indicating whether an electronic cigarette can be used unrestricted, in a restricted manner, or not at all. For example, as shown in FIG. 3, a remote signal station such as remote station 58 may transmit a control signal that is received by an electronic cigarette device such as device 10. The signal station may be associated with a particular establishment (e.g., a school, restaurant, bar) and transmit usage control data placing restrictions on usage of the device within or near the establishment. Upon receiving a use signal from a user (164), operation of the device can then be controlled (e.g., prevented, limited or modified) based on the control signal/data received from the signal station (166). In some instances, the control circuit can determine that based on the data, a user can use the device in an unrestricted manner (168). Alternatively, the control circuit can permit limited/modified use of the device (170), or prevent use of the device entirely (172). While in some embodiments control station 58 may be a general stationary control station associated with a particular location or establishment, in other embodiments, station 58 can be a mobile device (e.g., a cellular phone). As such, other users may be able to transmit control signals via their personal mobile devices indicating that they do not wish others to use electronic cigarettes or similar devices.

In response to receiving a use signal from a user (e.g., sensing a touch or inhalation), device 10, and more specifically, output 36, can be configured to provide one or more outputs to a user. The outputs may be visible, audible, tactile, or combinations thereof. For example, in one embodiment, should a user try to use device 10 in an area designated for limited/prohibited use, output device 36 may provide a blinking light, a beeping sound, or a vibration. The various outputs may take a variety of forms according to various alternative embodiments. For example, rather than a beep, output device 36 may provide a voice message (e.g., "You're not allowed to smoke near your wife"). Alternatively, should a user grab or touch device 10 while device 10 is in, for example, a user's pocket, output device 36 may provide a vibration to the user to indicate that use of device 10 may be limited or prohibited at the current location and time.

In yet further embodiments, control circuit 16 can be configured to provide a periodic indication of whether there are any restrictions on the usage of device 10. For example, in one embodiment, control circuit 16 can determine time and location data periodically (e.g., every 5 minutes, every 10 minutes, etc.), and based on the appropriate usage control data, determine whether device 10 can be used freely, on a limited basis, or not at all. In some embodiments, different outputs can be provided based on the available level of usage. For example, output device 36 may periodically provide different colored lights (e.g., green, yellow, red), different sounds or voice messages, or different tactile outputs to a user based on the level of availability.

It should be noted that while FIGS. 5-7 provide various examples of controlling operation of an electronic cigarette device based on various usage control parameters, or features, according to various other embodiments, other factors may be used in the control of the operation of the electronic cigarette device, and all such embodiments are within the scope of the present disclosure. For example, in some embodiments, a control circuit may limit the total amount of time an electronic cigarette can be used during certain time periods, while at certain locations, or while near certain other persons. Similarly, a control circuit may limit the total amount of liquid that can be used during certain time periods, while at certain locations, or while near certain other persons. Other types of limitations and/or modifications can be used to control the operation of the electronic cigarette device according to other alternative embodiments.

The present disclosure contemplates methods, systems, and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

Although the figures may show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. An electronic cigarette comprising:

a housing;

an atomizer disposed in the housing;

a transceiver disposed in the housing and configured to receive a control signal, wherein the transceiver is configured to establish a wireless communication connection with a plurality of devices and to communicate with the plurality of devices while maintaining the wireless communication connection; and a control circuit disposed in the housing and coupled to the transceiver, the control circuit configured to control operation of the atomizer based on the control signal, wherein the control signal includes information indicative of at least one specific person, other than a user of the electronic cigarette, proximate to the electronic cigarette, and wherein the electronic cigarette is configured to connect, using the transceiver, to a mobile device of the user of the electronic cigarette and to a second mobile device associated with the at least one specific person other than a user of the electronic cigarette.

2. The electronic cigarette of claim 1, wherein the transceiver is configured to receive the control signal from a remote source.

3. The electronic cigarette of claim 2, wherein the remote source is stationary.

4. The electronic cigarette of claim 2, wherein the remote source is a mobile device.

5. The electronic cigarette of claim 1, wherein the control signal comprises at last one of time data, location data, user identification data, a control instruction and a control parameter.

6. The electronic cigarette of claim 4, wherein the control signal indicates limitations on usage of the electronic cigarette.

7. The electronic cigarette of claim 1, wherein the control circuit is configured to prevent operation of the atomizer based on the control signal.

8. The electronic cigarette of claim 1, wherein the control circuit is configured to direct the atomizer to modify an amount of liquid atomized by the atomizer based on the control signal.

9. The electronic cigarette of claim 1, wherein the control circuit is configured to direct the atomizer to modify a type of liquid atomized by the atomizer based the control signal.

10. The electronic cigarette of claim 1, wherein the atomizer is configured to store and atomize a liquid.

11. The electronic cigarette of claim 10, wherein the liquid includes nicotine.

12. The electronic cigarette of claim 10, wherein the atomizer is configured to store first and second liquids, and wherein the control circuit directs the atomizer to selectively atomize one of the first and second liquids based on the control signal.

13. The electronic cigarette of claim 12, wherein the second liquid has a different nicotine content from the first liquid.

14. The electronic cigarette of claim 1, wherein the control circuit is configured to control operation of the atomizer further based on identifying a current user of the electronic cigarette.

* * * * *